US005411266A

United States Patent [19]

Guthry

[11] Patent Number: 5,411,266

[45] Date of Patent: May 2, 1995

[54] ALIGNMENT AND SETUP DEVICE FOR GOLF TRAINING ACTIVITIES

[75] Inventor: Joe M. Guthry, The Woodlands, Tex.

[73] Assignee: Pro Gruv, Inc., The Woodlands, Tex.

[21] Appl. No.: 243,922

[22] Filed: May 17, 1994

[51] Int. Cl.[6] ..... A63B 69/36

[52] U.S. Cl. ..... 273/187 R; 273/35 A

[58] Field of Search ..... 273/187 R, 187.1, 35 A, 273/187 A, 187 B, 187.2, 187.6

[56] References Cited

U.S. PATENT DOCUMENTS

| | | | |
|---|---|---|---|
| D. 198,459 | 6/1964 | Blythe | 273/35 A X |
| 1,558,762 | 10/1925 | Richter | 273/35 A |
| 1,922,130 | 8/1933 | Haserodt | 434/252 X |
| 2,169,407 | 8/1939 | Crowley | 273/187 R |
| 3,166,327 | 1/1965 | Champion | 273/187 R |
| 3,229,981 | 1/1966 | Taber | 273/187 R |
| 3,244,421 | 4/1966 | Hanna | 273/187 R |
| 3,343,268 | 9/1967 | Schennum | 273/187 R |
| 3,658,344 | 4/1972 | Kimble | 273/187 R |
| 3,868,116 | 2/1975 | Ford | 273/187 R X |
| 3,915,457 | 10/1975 | Casey | 273/35 A |
| 3,934,882 | 1/1976 | Whittaker | 273/35 A X |
| 4,322,084 | 3/1982 | Reece | 273/187 R |
| 4,354,683 | 10/1982 | Woolland | 273/187 R |
| 4,383,687 | 5/1983 | Wolff | 273/35 A |
| 4,563,010 | 1/1986 | McDorman | 273/187 R |
| 4,736,952 | 4/1988 | Taft | 273/187 R X |
| 5,014,994 | 5/1991 | Peters | 273/187 R |
| 5,015,084 | 5/1991 | Kryder | 273/35 A X |
| 5,110,132 | 5/1992 | Weston et al. | 273/187 R |
| 5,116,058 | 5/1992 | Theriault | 273/187 R X |
| 5,246,234 | 9/1993 | Zambelli | 273/187 R |
| 5,255,921 | 10/1993 | Spence | 273/187 B X |
| 5,275,570 | 1/1994 | Hicks | 434/252 |
| 5,350,177 | 9/1994 | Furbush | 273/187 R X |

*Primary Examiner*—George J. Marlo

*Attorney, Agent, or Firm*—Bush, Moseley, Riddle & Jackson

[57] ABSTRACT

A setup and alignment device is provided according to the present invention to enable golfer's to establish a proper setup, body alignment and body position for achieving a proper golf club swing with each of the various golf clubs being used. The device employs an adjustable, pantograph-like ruler positioner having ruler support and guide positioners that maintain a parallel relation with one another at all relative spacing thereof. To these ruler positioning bars are releasably affixed respective ball position and stance rulers which are maintained in parallel relation by the positioning bars and which are provided with indicia to identify measured stance and ball position. The ball position and stance rulers each define respective straight edges which, when the apparatus is being used, will establish a target line that can be directed precisely at the intended target. A reflective panel having a reference line thereon is movably positioned on the stance ruler to enable the golfer to visualize the entire upper body and ensure parallel positioning of the hips and shoulders of the golfer with respect to the target line.

14 Claims, 4 Drawing Sheets

FIG. 1
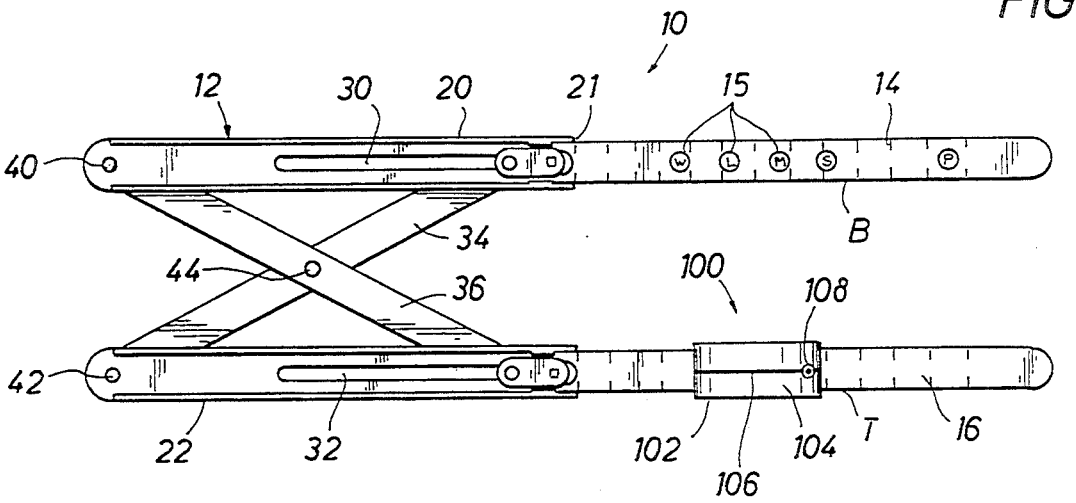
FIG. 6
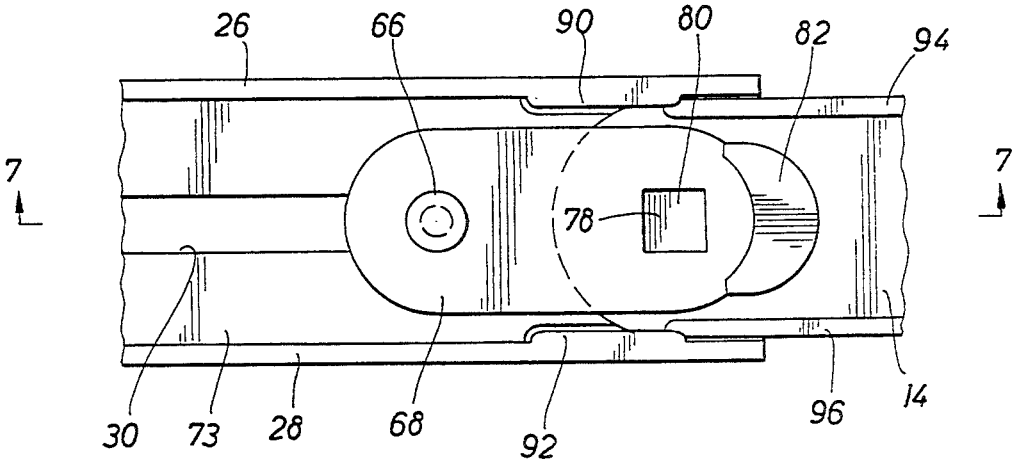
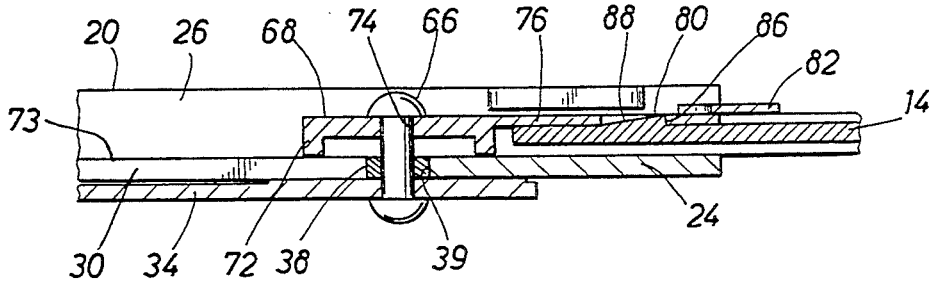
FIG. 7

ALIGNMENT AND SETUP DEVICE FOR GOLF TRAINING ACTIVITIES

FIELD OF THE INVENTION

This invention relates generally to golf training devices which are used by golfers to achieve proper body position and orientation relative to an intended target such as a golf green, fairway, etc. and which establish proper address of the golfer to a golf ball so the golfer with a proper swing will be likely to strike the golf ball with a golf club in such manner that the trajectory of the ball is toward the intended target. More specifically, the present invention concerns an alignment and setup device for golfers which can be easily transported in a golf bag and which can be used during practice activities to assist a golfer in establishing a desired body and club alignment and setup relative to an intended target and golf ball so that over time the golfer can establish automatic muscle control for accuracy and consistency of the golf swing.

BACKGROUND OF THE INVENTION

In view of the fact that the game of golf is played in such manner that a golf ball must be consistently hit widely varying distance to a wide variety of intended targets, a variety of golf clubs are used, including woods for long distances, long irons for significant distance and control, medium range irons for intermediate distances, short range irons for short distances and a putter for controlled ball movement on golf course greens. It is necessary for golfers to consistently hit each of these golf club so that the ball flight and intended distance are achieved with a high degree of consistency. To accomplish this, it is necessary for the golfer to establish a proper target line to an intended target. It is then appropriate for the golfer to place the golfer's body parallel to the target line. This is typically accomplished by placement of the toes of the golfer's shoes along an imaginary target line that extends from the golfer to the target. This activity is generally known as "alignment" and "set up". Teaching professionals generally position a golf club on the ground with the shaft of the club in alignment with the target. The golfer will then position the feet so that the toes of the golfer's shoes will touch or nearly touch the shaft of the club so that the golfer will get the feel of positioning the feet relative to a line to the target. Since the target line is always imaginary it frequently becomes very difficult for a golfer to determine proper alignment of the feet with an intended target. When body misalignment occurs the golfer's stance or position of the feet will be "open" or "closed" relative to the target line and the resultant flight of the ball will naturally be left or right of the target which is in most cases undesirable. When this occurs, golfer's tend to compensate for body alignment error by adjustment of the golf swing. The golfer's muscles then become "tuned" to an improper golf swing and it becomes very difficult for the golfer to correct body alignment problems without the services of a teaching professional. It is desirable to provide golfer's with the capability of simply and efficiently mechanically establishing body setup and alignment relative to an intended target during practice activities so that a proper golf swing can be more easily verified and the muscles of the golfer can be tuned during practice to consistently achieve a normal golf swing.

It is also necessary in order to achieve a normal golf swing for the golfer to achieve a proper stance relative to the golf club that is being swung so that the spacing of the golfer's shoes, i.e. width of the stance can be properly established. Obviously, the width of the golfer's stance, i.e. spacing of the feet will vary with the golf club that is being swung, i.e. woods, long irons, short irons, etc. and the ball position relative to the target line and the golfer's feet will also vary according to the particular club that is being used. It is also necessary that the hips and shoulders of the golfer be positioned parallel to the target line when setup and alignment is being established. Thus, for a consistent golf swing the golfer must have the capability of consistently positioning the shoulders and hips parallel to the target line at the beginning of the golf swing. Since it is very difficult and impractical to mentally consider all of these variables at the time setup and alignment is being established and the golf swing is being initiated, it is necessary for the golfer to achieve automatic muscle control through repetitive practice swings so that in actual play virtually all of these variables are accommodated by automatic muscle control without requiring the golfer to specifically think about them.

Although much of the golf practice activities that are done occur at driving ranges so that golfers can visualize the flight of the ball and make adjustments and corrections to hopefully achieve more consistency in setup, alignment and swing, the necessity to physically travel to a training facility of this nature often deters the amount of practice that is necessary for the golfer to develop automatic muscle control and achieve proper setup, alignment and swing. Thus, it is also appropriate to provide golfers with the capability of achieving golf swing practice at home, such as in the backyard, recreational room, etc. and to practice regularly throughout the year, even during inclement weather conditions so that when the golfer will be more likely when actually playing golf to easily achieve proper setup, alignment and swing. It has been proven that when this occurs the golfer will achieve better, more accurate and more enjoyable play. Heretofore apparatus has not been available to enable the golfer to achieve consistent practice and, without the aid of a teaching professional to ensure proper setup, alignment and swing. It is to these needs and desires that the present invention is addressed.

SUMMARY OF THE INVENTION

It is a primary feature of the present invention to provide a novel setup, alignment and swing training device that can be simply and efficiently used virtually anywhere to enable golfers, with or without the assistance of a teaching professional, to ensure proper body setup and alignment for a golf swing with any selected golf club so that automatic muscle control can be effectively developed through frequent repetitive training activities with the setup and alignment device of this invention.

It is also a feature of the present invention to provide a novel setup and alignment device for golfers which is adjustable to accommodate selected positioning of the golfer for proper setup, alignment and swing with woods, long irons, medium irons and short irons as well as being properly positionable for golf ball putting activities.

It is even a further feature of this invention to provide a novel setup and alignment device for use by golfers which is readily collapsible to a significantly small dimension that it is readily transportable in the golf bag of a golfer so that it can be virtually always available for immediate use.

It is also a feature of this invention to provide a novel alignment and setup device for golfers which enables the golfer to visualize the position of the shoulders and hips relative to a target line so that proper body alignment and setup can be perceived during training and duplicated during actual play.

Briefly a setup and alignment device is provided according to the present invention for enabling golfers to establish a proper setup, body alignment and golf club swing and through controlled practice to develop automatic muscle reaction for a consistent and repeatable golf swing. The device incorporates an elongate stance ruler which is adapted to lie on the ground or other surface and which establishes substantially straight target line with which the toes of the golfer's shoes are selectively positioned during use. An elongate ball position ruler, also adapted to be positioned on the ground in substantially parallel relation with the stance ruler and establishes a substantially straight ball position line that is intended for parallel relation with the target line of the stance ruler. A means is provided to establish movable interconnection between the stance and position rulers and to maintain a parallel relation between the target line and the ball position line of the rulers at all relative positions thereof. This ruler position control means, according to the preferred embodiment, may conveniently take the form of a pantograph mechanism which also establishes a ball position reference. Indicia is provided on both the stance ruler and the ball position ruler which enables the user, after a period of practice time that is dependent upon the user's capability and the frequency of use, to establish a proper stance and body position for efficient and effective striking of a golf ball to achieve desire trajectory and distance of the flight of the golf ball. Reference indicia on the ball position ruler is identifiable by the position of the indicia relative to the ball position reference to enable the golfer to identify the proper position of the ball relative to the golfer's stance for each of the various golf clubs that are used by the golfer. The setup and alignment device of the present invention enables golfers to visually verify the golfer's body position relative to the setup and alignment device through the provision of a convexly curved body position element having a mirror-like reflective surface and one or more reference lines that enable the golfer to align the body with the shoulders and hips oriented parallel to the intended target line that is established by the stance ruler. The body position device also includes positioning means in the form of a circular spirit level that can be selectively oriented to insure that the device establishes a proper reference for the golfer's body position.

The stance and ball position rulers of the device are connected to the pantograph-type parallel ruler positioner by a quick disconnect mechanism which enables quick assembly and disassembly of the device to facilitate its effective use. The setup and alignment mechanism is collapsible to a small, narrow dimension enabling it to be effectively carried in the golf bag of a golfer so that it is immediately available for use. The device is readily adjustable to accommodate proper setup and alignment for all of the various golf clubs that are employed by golfers, including setup and alignment for putting activities. Removable markers designated for woods, long irons, medium and short irons as well as the putter are included to enable the user to establish on the device personal reference points for these individual golf clubs which are found most effective for that particular golfer.

In use the setup and alignment device enables golfers to establish efficient setup and alignment of the body relative to the ball and to achieve a proper, repeatable golf swing so that over a period time the golfer will develop the automatic muscle control that is necessary for a repeatable golf swing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

FIG. 1 is a plan view of a setup and alignment device which is constructed in accordance with the present invention.

Figure 2:
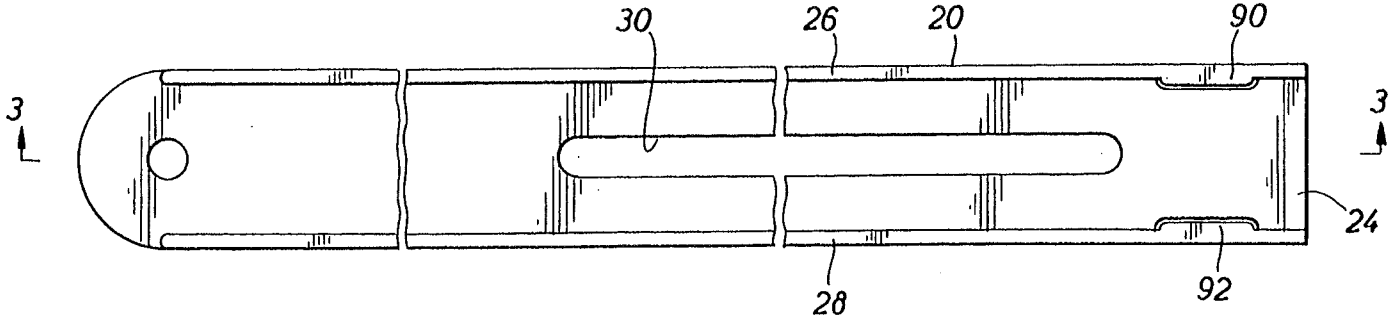

FIG. 2 is a plan view of the ruler orienting portion of the setup and alignment device of FIG. 1 having parts thereof broken away.

Figure 3:
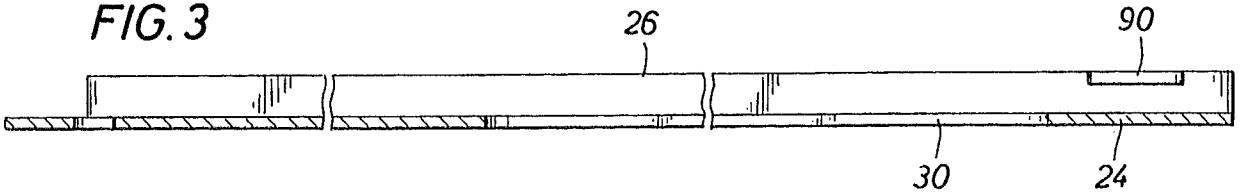

FIG. 3 is a sectional view taken along line 3—3 of FIG. 2.

Figure 4:
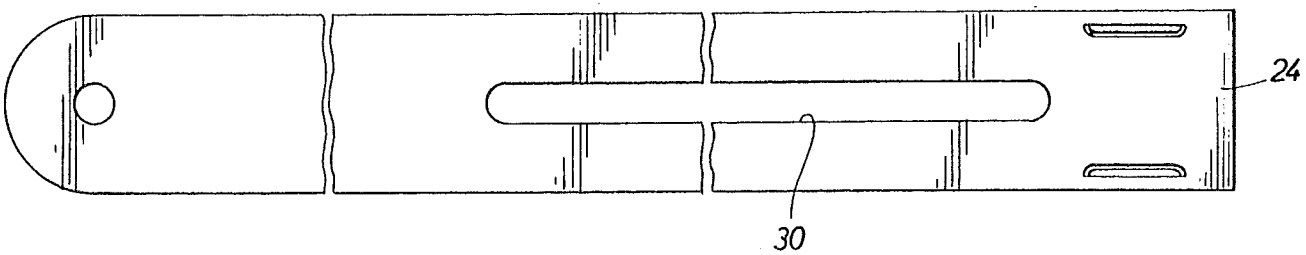

FIG. 4 is a bottom view of the ruler positioning section of FIG. 2.

Figure 5:
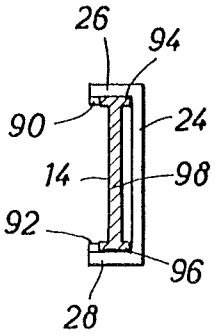

FIG. 5 is an end view of the ruler positioning section of FIG. 2.

FIG. 6 is a fragmentary plan view of the quick disconnect mechanism interconnecting the stance and ball positioning rulers in releasable assembly with the ruler positioner and the control links thereof.

FIG. 7 is a sectional view taken along line 7—7 of FIG. 6.

Figure 8:
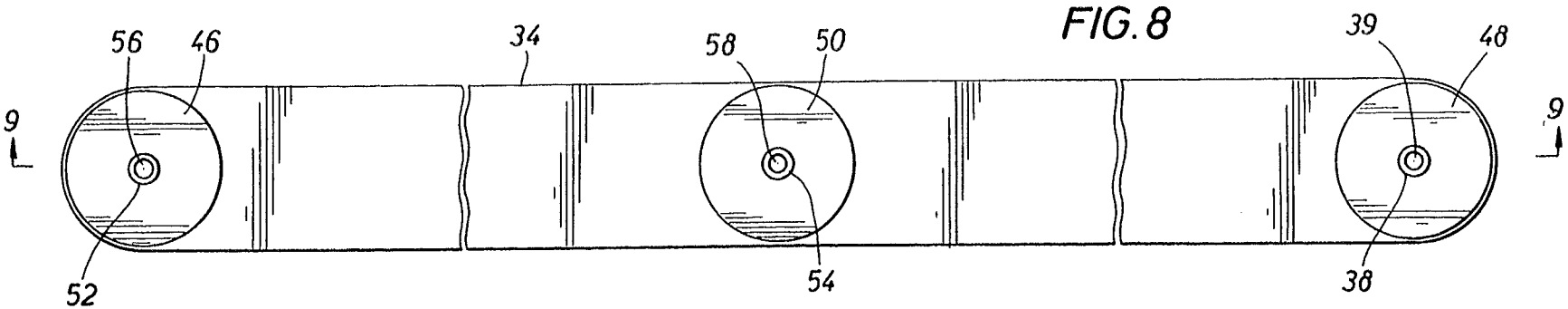

FIG. 8 is a plan view of one of the control inks of FIG. 1.

Figure 9:
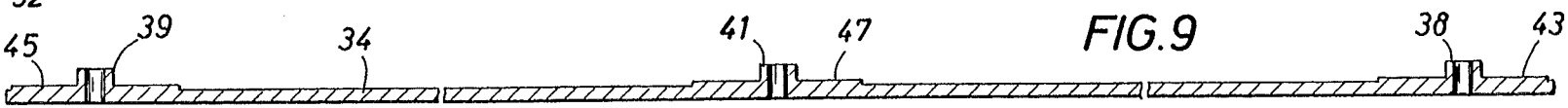

FIG. 9 is a section view taken along line 9—9 of FIG. 8.

Figure 10:
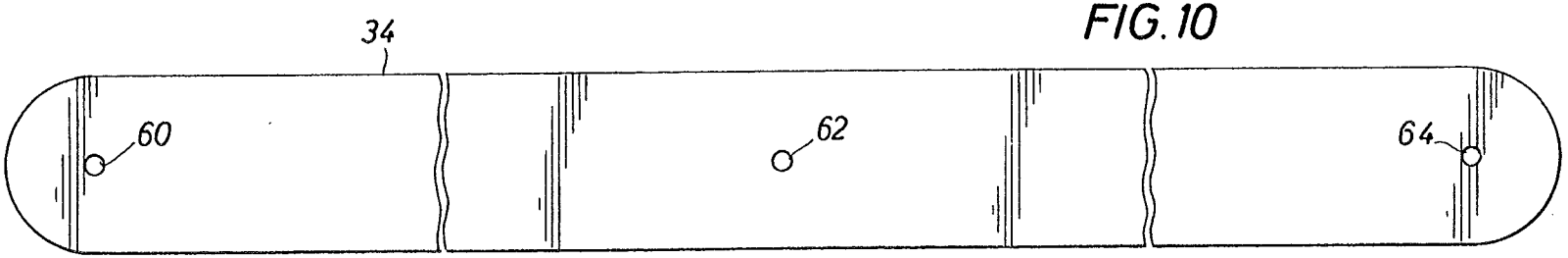

FIG. 10 is a bottom view of the control link of FIGS. 8 and 9.

Figure 11:
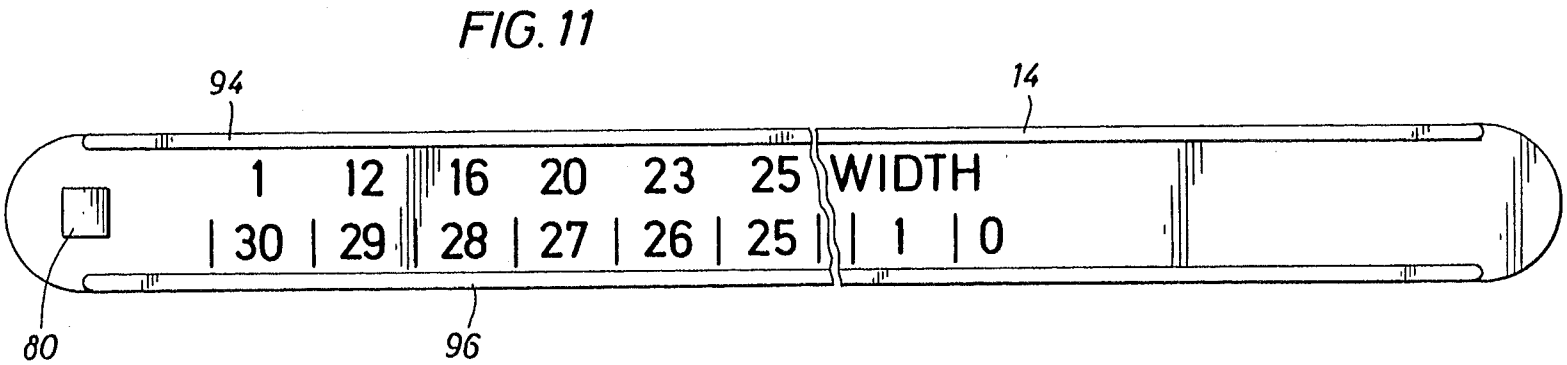

FIG. 11 is a plan view of a stance or ball position ruler of FIG. 1 with parts thereof broken away.

Figure 12:
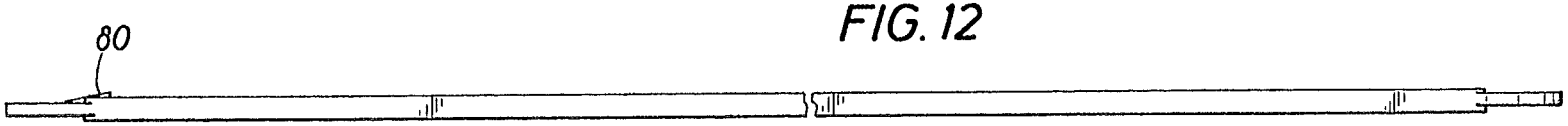

FIG. 12 is a side view of the ruler device of FIG. 11

Figure 13:
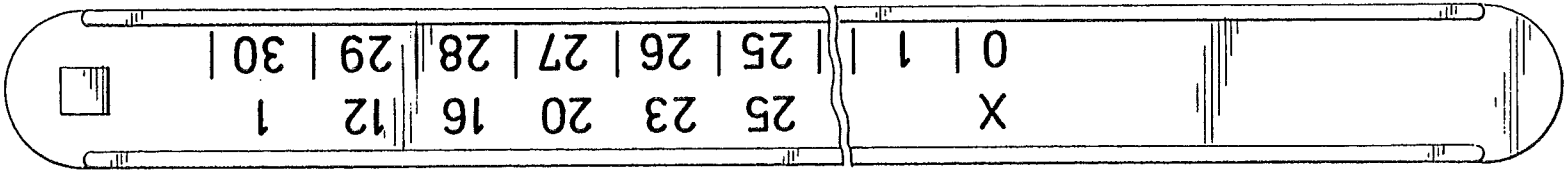

FIG. 13 is a bottom view of the ruler device of FIGS. 11 and 12.

Figure 14:
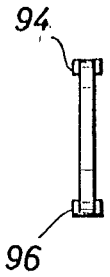

FIG. 14 is an end view of the ruler device of FIG. 11.

Figure 15:
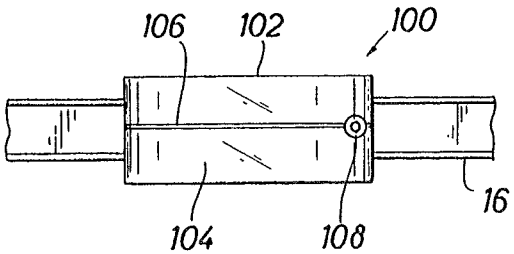

FIG. 15 is a plan view of the body position indicator portion of FIG. 9 illustrating assembly thereof to the stance ruler portion of the apparatus of FIG. 1.

Figure 16:
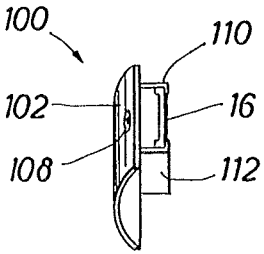

FIG. 16 is an isometric illustration of the body position indicator of FIG. 12 further illustrating assembly thereof to the stance ruler of FIG. 1.

DETAILED DESCRIPTION OF THE PREFERRED EMBODIMENT

Referring now to the drawings and first to FIG. 1 an alignment and setup device for golf training activities is shown generally at 10 which comprises the preferred embodiment of this invention and incorporates a ruler positioner section shown generally at 12 which is generally employed for achieving spacing and linear positioning of an elongate ball position ruler 14 and an elongate stance ruler 16. The setup and alignment mechanism also includes a reflective body positioning element shown generally at 18. The purpose of these components will be described in detail herein below.

The ruler positioning section 12 of the setup and alignment device incorporates a pair of elongate ruler positioning bars 20 and 22 which are preferably straight elongate members but which may have any other suitable configuration without departing from the spirit and scope of this invention. These ruler positioning bars may be identical if desired and may conveniently take the form shown in FIGS. 2–5 wherein there is shown a central substantially planar web 24 having side flanges 26 and 28 formed integrally therewith and extending along substantially the entire length thereof. The central web of each of the ruler positioning bars defines elongate substantially straight slots 30 and 32 which receive guide means located at the end portions of a pair of positioner links 34 and 36 which are shown in greater detail in FIGS. 8–10. As shown in FIG. 7 and in FIGS. 8–10 the guide means may conveniently take the form of guide projections 38 which are formed integrally with the respective positioner links and which have a diameter dimension that constitutes a close, guiding fit within the respective elongate guide slot 30 or 32 as the case may be. The guide projection 38 is preferably of circular configuration but it may be rectangular or of other suitable configuration so long as it achieves a rather close, guiding fit within the guide slot. The positioner links 34 and 36 are connected by pivots 40 and 42 to respective end portions of the elongate ruler positioning bars and are pivotally interconnected to one another intermediate the length thereof by a pivot member 44. The positioner links cooperate with one another and with the elongate ruler positioning bars of the ruler positioning section so as to establish a pantograph type action maintaining a parallel relation of the ruler position bars 20 and 22 at all relative positions thereof. The positioner links 34 and 36 are typically substantially flat members as shown in FIG. 7 and as further illustrated in FIGS. 8, 9 and 10. One of the positioner links 34 is provided with slightly raised circular areas 46 and 48 at respective ends thereof and a intermediate raised area 50. Circular projections 52 and 54 are located centrally of the raised areas 46 and 50 and surround pivot holes 56 and 58. These circular projections 52 and 54, like circular projection 38 function as integral bushings which are positioned about pivot pins, rivets or pivot bolts and are received respectively within circular holes 60, 62 and 64 of the opposite positioning link 36. The positioner links, like the ruler positioning bars 20 and 22, are preferably composed of any one of number of suitable polymer materials which can be manufactured by molding. In the alternative, these components of the ruler positioning section may be formed of metal or any other suitable material having sufficient rigidity for maintaining proper position of the positioning bars during relative spreading or collapsing movement thereof. As shown in FIG. 7 a rivet member 66 extends through the opening 39 of the guide projection 38 and functions to secure the positioning link 34 with the positioning bar 20. Additionally the rivet 66, which may alternatively take the form of a pivot bolt secured by a nut or the like, serves also to secure a quick release clip 68 in movable assembly with the respective positioning bar 20 or 22 such that it is movable along the length of the guide slot 30 as the positioning bars are adjustably spread or collapsed.

It is desirable to connect the ball positioning ruler and the stance ruler to the respective positioning bars 20 and 22 in such manner that they are linearly movable relative thereto to the extent permitted by the length of the guide slots 30 and 32. Although the rulers may be connected by bolts, screws or rivets to respective end portions of the positioner links, to minimize the overall length of the apparatus for purpose of storage and to provide for quick and simple assembly and disassembly, quick disconnect type connecting arrangements are employed. In one suitable form the quick release clip 68 defines a substantially fiat web portion 70 as shown in FIG. 7 having a circular flange 72 defined integrally therewith and adapted to establish sliding engagement with the upper surface 73 of the central web 24. The quick release clip also defines an opening 74 centrally of the circular flange 72 through which the rivet or other pivotal connecting device 66 extends. The quick release clip 68 also defines an integral, relatively thin and flexible portion 76 which defines a central opening 78 within which is received an angulated locking projection 80 that is defined integrally with one end of each of the ruler elements 14 and 16 which are shown in greater detail in FIGS. 11–14. At the free end of the flexible section 76 of the quick release clip there is provided a lifting tab 82 which is preferably defined integrally with the quick release clip and which is normally engaged by the finger of the user and lifted so that a locking surface 84 of the quick release clip can be raised to a position clearing a locking shoulder 86 of the locking projection 80 when ruler release is desired. The inclined locking projection 80 defines a tapered cam surface 88 which, when the ruler 14 is inserted beneath the quick release clip, will urge the flexible portion 76 of the quick release clip upwardly thus clearing the locking projection as the ruler is inserted into locking connection. After the ruler has been inserted a predetermined distance the locking projection will become registered with the locking opening 78, thereby permitting the flexible portion 76 of the quick release clip to snap into place with its shoulder surface 84 in restraining engagement with the shoulder surface 86 of the locking projection. In order to guide the inserted extremity of the ruler as it is moved for locking engagement with the quick release clip 68 a pair of inwardly projecting flanges 90 and 92 are formed on the respective side flanges 26 and 28 so that respective side flanges 94 and % of the respective ruler 14 or 16 are received in guided relation between the respective guide flanges 90 and 92 and the central web portion 24 of the respective ruler positioning bar. As shown in FIG. 5 the ruler 14 with its central web 98 and side flanges 94 and 96 is shown positioned in guided relation by the guide flanges 90 and 92.

The ball position ruler 14 and the stance ruler 16 are each provided with appropriate indicia to enable the user to position the feet at the proper width or stance as the ball is being addressed with the respective golf club and to position the ball at a desired distance in front of the user and at a desired position in relation to an imaginary center line extending between the user's feet and intersecting the rulers in normal relation. The ruler positioning bar 20 defines a reference 21 at one end thereof with which the indicia of the ruler is compared to identify the relative spacing between the target line T and the ball position line B that are defined by the respective rulers. Through practice, the golfer will quickly be able to ascertain the proper stance and ball distance for each of the golf clubs being used. As the pantograph type ruler positioning section is adjustably expanded or contracted, the elongate ruler positioning bars 20 and 22 remain parallel and therefore the ball positioning ruler 14 and the stance ruler 16, being guided thereby, also remain precisely parallel. The positioning bars and rulers may be placed very close together for use during training for putting because the golfer will stand more over the ball when using the putter than when using other golf clubs. The length of the guide slots 30 and 32 is such that the ruler positioning bars and the rulers may be positioned at a spacing of about 30 inches maximum such as when tall persons are training with woods. At the nearly fully collapsed positions of the positioning bars and rulers, such as for putting training, the rulers can be only 3 or 4 inches apart. In the fully collapsed position such as for storage, transportation in a golf bag or the like, the positioning bars 20 and 22 may be in contact with one another. Typically, in this case the ball positioning ruler and the stance ruler will be removed by releasing the quick disconnect element so that the so that the overall length of the device will be defined only by the length of the ruler positioning bars. When desired stance and ball locations have been established, stick-on type markers 15 marked with "W" for woods, "L" for long irons, "M" for medium irons, "S" for short irons and "P" for putter can be used to identify particular ball locations and stance locations on the stance and ball position rulers to temporarily mark desired ruler locations. These temporary markers can help the user to remember particular ruler locations that benefit effective practice.

It is desirable for setup and alignment training and in preparation for the golf swing that a golfer have the capability of visualizing the positions of the shoulders and hips so that they may be maintained parallel to the target line as the golf ball is being addressed. Heretofore this has not been possible. Accordingly, as shown in FIG. 1 and in FIGS. 15 and 16 to the stance ruler 16 is movably connected a body position indicator device shown generally at 100, which preferably comprises an elongate panel 102 having a reflective mirror-like surface 104 in which the golfer may see the golfer's reflection. A guide line 106 is located centrally of the panel 102 and typically extends the length of the panel. The reflective panel 102 is of convex configuration or otherwise defines a convex reflective surface facing the golfer so that, as seen by the golfer, the entire upper body of the golfer may be effectively visualized in the reflective surface 104. This enables the golfer to visually ascertain the position of the shoulders and hips when setup and alignment is being accomplished. At one of the reflective surface, preferably away from the golfer, there is provided a spirit level 108 which enables the golfer to appropriately position the reflective panel to provide intended results. As is evident from FIG. 16 the underside of the reflective panel structure is provided with a pair of retainer and guide clips 110 and 112 which enable the body position device to be movably connected to the stance ruler 16 and movable adjusted along the length of the stance ruler as is desired by the golfer. The location of the body position device along the length of the stance ruler will be determined by the width or stance of the user which is in turn determined by the length of the golf club that is being utilized at any given time. While addressing the golf ball the golfer can glance downwardly and compare the golfer's reflection with the guide or reference line 106 to ensure that the shoulders and hips are parallel to the target line.

Thus, the position of the stance ruler determines the position of the golfer's shoes in relation to the target line and also in relation to the particular golf club that is being used. The ball position ruler is utilized by the golfer to determine the proper location of the ball in relation to the golfer and also in relation to the particular golf club that is being used at the time. To complete the setup and alignment assembly the body position device 100 is located along the stance ruler at a particular location that is determined by the golfer's stance. Thus, the golfer is readily capable of assuring alignment of the feet with the target line. Alignment of the hips and shoulders with respect to the target line and proper ball position is determined by the golf club being used and the particular ball striking characteristics of the golfer. By consistently using the setup and alignment device of the present invention, the golfer can consistently practice with the variables of practice being effectively controlled so that automatic muscle reaction can be developed in a relatively short period of time to enable the golfer, when in actual play, to more consistently strike the ball and more consistently direct the flight of the ball precisely at the intended target.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A setup and alignment device for enabling golfers to establish a proper setup, body alignment and golf club swing and through controlled practice to develop automatic muscle reaction for a repeatable golf swing, said device comprising:

(a) an elongate, stance ruler adapted to lie on the ground and establishing a substantially straight target line with which the toes of the golfer's shoes are selectively positioned during use;

(b) an elongate ball position ruler adapted to lie on the ground and establishing a substantially straight ball position line being disposed in parallel relation with said target line;

(c) means establishing movable interconnection between said stance and position rulers and maintaining parallel relation of said target line and said ball position line at all relative positions of said stance and position rulers and establishing a ball position reference;

(d) indicia on said stance ruler enabling golfer to identify spacing measurement of the golfer's shoes in relation to said stance ruler; and (e) indicia on said ball position ruler for identifying relative to said ball position reference the spacing of said target line and said ball position line and for enabling selective ball positions relative to said ball position line.

2. The golf swing training device of claim 1, wherein said means establishing movable interconnection between said stance and position ruler comprises:

(a) a pair of link elements being pivotally connected to one another and respectively having pivotal connection with said stance ruler and said ball position ruler, said link elements further having respective linear guided movable connection with said stance ruler and ball position ruler.

3. The golf swing training device of claim 2, wherein: said link elements are pivotally interconnected with one another and with said stance and ball position rulers to define a pantograph like movable relationship.

4. The golf swing training device of claim 2, wherein: said stance ruler and said ball position ruler each define elongate guide means having guiding engagement with respective link elements to thus define a movable pantograph-like relationship.

5. The golf swing training device of claim 4, wherein:

(a) an elongate, substantially straight guide slot being defined by each of said stance ruler and ball position ruler;

(b) guide elements being defined by each of said link elements and being received in linearly movable guided relation within a respective guide slot.

6. The golf swing training device of claim 1, wherein said means establishing movable interconnection between said stance and ball position rulers comprises:

(a) a pantographic ruler positioner having a pair of ruler positioner elements each defining elongate guide means;

(b) a pair of link elements having pivotal connection with one another and having respective pivotal connection with said parallel positioner elements, said link elements further having respective guide elements disposed in guided interconnection with said elongate guide means and maintaining said ruler positioner elements in parallel relation at all relative spaced positions thereof; and (c) releasable connecting means establishing releasable connection of said stance and ball position rulers with respective link elements and maintaining said stance and ball position rulers in linearly movable guided relation with respective ruler positioner elements.

7. The golf swing training device of claim 6, wherein said releasable connecting means comprises:

(a) a connecting element being pivotally connected with a respective link element and defining a connection aperture; and (b) a connecting projection being provided on each of said stance and ball position rulers and being receivable within said connecting aperture.

8. The golf swing training device of claim 7, wherein: said pivot extends through said connecting element, said link element and said elongate guide slot.

9. The golf swing training device of claim 7, wherein:

(a) said link elements each define a guide projection being received in guided relation within said elongate guide slot; and (b) said stance and ball position rulers each establish guided relation respectively with said parallel positioner elements and being linearly movable in relation therewith responsive to change in spacing of said parallel positioner elements.

10. The golf swing training device of claim 9, wherein:

(a) at least one of said parallel positioner elements establishing said ball positioner reference;

(b) ball position indicia being located on said ball position ruler and identifying relative measured spacing of said ball position line and said target line.

11. The golf swing training device of claim 1, further comprising:

a body position element being selectively positionable on said elongate stance ruler and defining a reflective surface enabling the golfer to see the golfers reflected image thereon said body position element defining reference means enabling the golfer by controlling positioning of the hips and shoulders of the golfer in parallel relation with said stance ruler.

12. The golf swing training device of claim 11, wherein:

a guide element projecting from the underside of said body position element and being disposed in movable guided assembly with said elongate stance ruler.

13. The golf swing training device of claim 11, wherein:

said reflective surface of said body position element is of convex configuration enabling the golfer to visualize the entire upper body of the golfer in said reflective surface.

14. The golf swing training device of claim 11, wherein said reference means comprises:

a reference line on said reflective surface and being oriented in substantially normal relation with said target line.

* * * * *